US006148856A

United States Patent [19]

Kropp

[11] Patent Number: 6,148,856

[45] Date of Patent: Nov. 21, 2000

[54] CONTROL VALVE

[75] Inventor: Walter Kropp, Sulzbach am Main, Germany

[73] Assignee: Linde Aktiengesellschaft, Germany

[21] Appl. No.: 09/266,224

[22] Filed: Mar. 10, 1999

[30] Foreign Application Priority Data

Mar. 19, 1998 [DE] Germany ..... 198 12 109
Nov. 9, 1998 [DE] Germany ..... 198 51 553

[51] Int. Cl.[7] ..... F15B 11/04; F15B 13/04

[52] U.S. Cl. ..... 137/596; 91/446; 137/625.68

[58] Field of Search ..... 91/446; 137/596, 137/625.68

[56] References Cited

U.S. PATENT DOCUMENTS

| | | | |
|---|---|---|---|
| 3,774,635 | 11/1973 | Farrell et al. | 137/625.68 X |
| 3,910,311 | 10/1975 | Wilke | 137/596 |
| 3,985,153 | 10/1976 | Thomas | 137/596 |
| 4,117,862 | 10/1978 | Qureshi | 137/625.68 X |
| 4,187,877 | 2/1980 | Hodgson et al. | 137/625.68 X |
| 4,388,946 | 6/1983 | Richter et al. | 137/625.68 X |
| 4,520,841 | 6/1985 | Brand et al. | 137/625.68 X |
| 4,617,798 | 10/1986 | Krusche et al. | 137/625.68 X |
| 4,705,069 | 11/1987 | Fertig | 137/625.68 X |
| 4,738,279 | 4/1988 | Kropp | 137/625.68 X |

FOREIGN PATENT DOCUMENTS

| | | | |
|---|---|---|---|
| 2647140 | 4/1978 | Germany | 137/596 |
| 2649775 | 5/1978 | Germany | 137/596 |
| 2149887 | 6/1985 | United Kingdom | 137/625.68 |

*Primary Examiner*—Gerald A. Michalsky
*Attorney, Agent, or Firm*—Webb Ziesenheim Logsdon Orkin & Hanson, P.C.

[57] ABSTRACT

The invention relates to a control valve for the control, independently of a load, of a hydraulic consumer with a distributing slide valve to control the direction of movement and the speed of movement of the consumer and a throttle valve associated with the distributing slide valve. The throttle valve, when there is a connection of a pump with the consumer, can be pressurized toward an open position by the pressure downstream of the throttle point of the distributing slide valve, and toward a closed position by the load pressure of the consumer and by a spring. The invention teaches that the object of providing a control valve that easily makes possible a restriction of the quantity of hydraulic fluid flowing out of the consumer to a reservoir and thus a control of the speed of movement of the consumer in the discharge direction independently of the load, can be accomplished if, when the consumer is connected with a reservoir, the quantity of hydraulic fluid flowing out of the consumer is restricted by the throttle valve. In one embodiment, when the consumer is connected with the reservoir, the throttle valve can be pressurized toward the closed position by the pressure upstream of the throttle point of the distributing slide valve, whereby the pressure acting in the direction of the closed position of the throttle valve can be set and varied by a valve device that generates a differential pressure.

15 Claims, 5 Drawing Sheets

CONTROL VALVE

BACKGROUND OF THE INVENTION

1. Field of the Invention

This invention relates generally to a control valve for the control of a hydraulic consumer, independently of the load, having a distributing slide valve to control the direction of movement and the speed of movement of the consumer and a throttle valve associated with the distributing slide valve which, when a pump is connected with the consumer, can be pressurized toward an open position by the pressure downstream of a throttle point of the distributing slide valve and toward a closed position by the load pressure of the consumer and by a spring.

2. Description of the Currently Available Technology

Control valves with an associated throttle valve, for example, a pressure balance, are used in load-sensing drive systems. When a pump is connected with the consumer, for example, to lift a load that is being exerted on a hydraulic cylinder, these control valves control the speed of movement specified by the aperture width of the control valve, regardless of the load that is being exerted on the consumer. In this case, for example, the throttle valve is located downstream of the control valve and is pressurized in the closing direction by the force of a spring and by the load pressure being exerted on the consumer and is pressurized in the opening direction by the pressure downstream of the throttle point of the control valve. When the consumer is connected to the pump, the pressure differential at the control valve is kept constant by the throttle valve, even when the load pressure of the consumer varies. As a result of which, the quantity of hydraulic fluid flowing from the pump to the consumer remains constant and the speed of movement specified by the aperture width of the distributing slide valve is kept constant.

When the consumer is connected with a reservoir, for example, to lower a load that is being supported by a hydraulic cylinder, the speed of movement is also specified by the aperture width of the control valve. The pressure in the control pressure chamber of the throttle valve that acts toward the closed position is thereby relieved toward the reservoir so that the throttle valve is pressurized into the open position by the pressure downstream of the throttle point of the control valve. Consequently, the quantity of hydraulic fluid flowing from the consumer to the reservoir through the throttle point of the control valve is a function of the load being supported by the consumer. However, and in particular with loads that are exerted in the discharge direction, such as loads that are suspended on hydraulic cylinders, for example, it is necessary to restrict the quantity of hydraulic fluid flowing out of the consumer and thus to limit the speed of descent of the consumer.

To limit the speed of movement of the consumer when the consumer is connected to the reservoir by means of the control valve, the prior art provides additional valves to achieve a control of the quantity of hydraulic fluid discharged from the consumer independently of the load, and thus to control the speed of movement of the consumer in the discharge direction. For this purpose, flow regulators or descent braking valves are used to restrict the speed of descent on hydraulic cylinders, in particular for suspended loads. The prior art also includes the use of throttle valves, in particular throttle screws, to restrict the speed of descent. However, these throttle valves act as a function of the load. On propulsion motors, the prior art provides propulsion braking valves in addition to the control valves to restrict the quantity of hydraulic fluid flowing out, whereby these braking valves bank up a brake pressure in the discharge side of the propulsion motor, for example, if the truck driven by the propulsion motor is traveling downhill.

It is an object of the invention to provide a control valve that makes it possible to easily and economically restrict the quantity of hydraulic fluid flowing out of a consumer to a reservoir, and thus to control the speed of movement of the consumer in the discharge direction independently of the load being exerted on the consumer.

SUMMARY OF THE INVENTION

The invention teaches that a throttle valve in a connection of a consumer to a reservoir restricts the quantity of hydraulic fluid being discharged. An important teaching of the invention is, therefore, to also use the throttle valve, which is present in any case and which is used for the control of the speed independently of the load in the direction of flow from the pump to the consumer, to control the speed of movement of the consumer substantially independently of the load in the direction of flow from the consumer to the reservoir, and thus to restrict the speed of movement of the consumer to the speed defined by the aperture width of the control valve in the discharge direction. No additional valves are therefore necessary for restriction of the quantity of hydraulic fluid flowing out of the consumer. As a result of which, the control valve can be manufactured easily. The amount of space required and the associated manufacturing costs can also be reduced by the elimination of additional valves.

One particular advantage of the invention is that when the consumer is connected with the reservoir, the throttle valve can be pressurized toward the closed position by the pressure upstream of the throttle point of the distributing slide valve. When the consumer is connected to the reservoir via the control valve, the throttle valve is pressurized toward the closed position by the pressure upstream of the outlet-side throttle point of the control valve and by a spring. The pressure downstream of the discharge side throttle point of the control valve acts in the direction of the open position of the throttle valve. By creating appropriate ratios between the surface areas of the control surfaces of the throttle valve acting in the opening direction and in the closing direction, it thereby becomes possible to specify a force that acts in the open position of the throttle valve and that controls the aperture width of the throttle valve. The quantity of hydraulic fluid that flows out and thus the speed of movement of the consumer in the discharge direction is therefore restricted by the throttle valve in a simple manner and independently of the load to the value specified by the aperture width of the distributing slide valve.

In one advantageous embodiment of the invention, when there is a connection between the consumer and the reservoir, the pressure acting toward the closed position of the throttle valve can be adjusted by means of a valve device that generates a differential pressure. Such a valve device reduces the pressure that is available on the input side of the valve device upstream of the discharge-side throttle point of the control valve by a specified pressure differential. As a result of which, the pressure acting in the direction of the closed position of the throttle valve is reduced in correspondence with the differential pressure generated at the valve device. It is thereby possible, in a simple manner, to specify a pressure differential that acts toward the open position of the throttle valve, and thus to control the speed of movement of the consumer in the discharge direction independently of the load, as a function of the deflection of the slide valve of the control valve. It is particularly advantageous if the differential pressure generated at the valve device can be varied. By varying the differential pressure, it is possible in a simple manner to vary the aperture width of the throttle valve and thus the quantity of hydraulic fluid flowing out of the consumer. It is thereby also possible, in a simple manner, on a double-action consumer, to adjust the quantity of hydraulic fluid discharged to the quantity of hydraulic fluid admitted to the consumer and, for example, to take into consideration the limit quantity of the pump or changes in the speed of the pump.

In one configuration of the invention, the differential pressure that can be generated at the valve device can be varied by means of a spring, in particular an adjustable spring. The pressure upstream of the throttle point of the distributing slide valve can thus be reduced as a function of the spring bias, and pushes the throttle valve toward the closed position. By means of an adjustable spring, it is easily possible to vary the differential pressure generated at the valve device and thus to define the aperture width of the throttle valve, whereby the quantity of hydraulic fluid discharged can be adjusted to the quantity of hydraulic fluid admitted.

In one refinement of the invention, the differential pressure that can be generated at the valve device can be varied as a function of the pressure differential formed from the pump pressure and the load pressure of the consumer. It is thereby possible in a simple manner to take into consideration the limit quantity of the pump during the adjustment of the quantity of hydraulic medium being discharged from the consumer. The pressure difference between the pump pressure and load pressure can thereby act on the valve device such that when there is a reduction in this pressure difference, the differential pressure that can be generated at the valve device decreases. Consequently, the differential pressure at the throttle valve acting in the direction of the closed position increases, as a result of which there is a lower pressure difference acting on the throttle valve toward the opening direction. Thus, the quantity of hydraulic medium discharged is reduced. These measures also make it possible to take into consideration fluctuations in the stream of hydraulic fluid flowing into the consumer, for example, as a result of variations in the speed of the pump, by means of a corresponding variation of the quantity of hydraulic fluid discharged.

In this case, it is particularly appropriate if there is an auxiliary piston that is effectively and operationally connected with the valve device. The auxiliary piston can be pressurized by the pump pressure in the direction of an increase in the differential pressure of the valve device, and by the load pressure of the consumer in the direction of a reduction of the differential pressure of the valve device. It is thereby possible on the valve device to hydraulically simulate in a simple manner the pressure difference formed from the pump pressure and the load pressure.

In one realization of the invention, the differential pressure that can be generated on the valve device can be varied electrically. The quantity of hydraulic fluid being discharged can also be adapted by electrical means to the limit quantity of the pump and to fluctuations in the stream of hydraulic fluid flowing to the consumer.

In this case, it is of particular advantage to provide a proportional magnet that is effectively and operationally connected with the valve device. The magnet is connected on the output side with an electronic regulating device which is connected on the input side with pressure sensors to measure the pump pressure and the load pressure of the consumer. The differential pressure that can be generated at the valve device and therefore the quantity of hydraulic fluid that flows out of the consumer to the reservoir is thereby determined by means of a proportional magnet, the setting of which is determined in the electronic regulating device based on the values of the pump pressure and load pressure determined by the pressure sensors.

In one embodiment, the valve device is located in a control pressure line that can be connected with the consumer and with a control pressure chamber that acts in the direction of the closed position of the throttle valve, and is realized in the form of a biased valve, in particular in the form of a spring-loaded check valve that opens toward the control pressure chamber. With a biased valve realized in the form of a spring-loaded check valve that is located in a control pressure line that runs from the consumer connection to the control surface that acts in the closing direction of the throttle valve, it is possible in a simple manner to generate a differential pressure in the control pressure line and thus to use the throttle valve to restrict the quantity of hydraulic fluid flowing out of the consumer. For this purpose, all that is necessary on the control valve is a corresponding control pressure line and the valve device.

In one particularly advantageous embodiment of the invention, the valve device is located in a control pressure line that can be placed in communication with the consumer and the control pressure chamber that acts toward the closed position of the throttle valve, and is in the form of a differential pressure control valve. With a differential pressure control valve, there is an improved independence of the differential pressure from the discharge pressure of the consumer. In particular when the control valve is used in a propulsion drive system to actuate a propulsion motor, it thereby becomes possible to keep the speed of movement set at the control valve constant and to thereby avoid an increase in the speed of movement of the propulsion motor in the event of a change in the load or downhill travel.

The differential pressure control valve advantageously has a tank relief to connect the control pressure line with a reservoir. By means of a separate tank relief of the control pressure line, whereby the current of hydraulic fluid flowing out of the control pressure line to the reservoir is actuated by the differential pressure control valve, it is possible to keep the differential pressure set at the differential pressure control valve constant, independently of the position of the control valve and thus independently of the quantity of hydraulic fluid flowing out of the consumer. With a valve device realized in the form of a differential pressure control valve with a separate tank relief, it is thereby possible to provide a differential pressure that is independent of the discharge pressure of the consumer and thus of the position of the control valve, and thus a differential pressure that is constant. By changing the differential pressure, the quantity of hydraulic fluid discharged can thereby be adjusted with great precision to the quantity of hydraulic fluid admitted for all operating conditions, independently of the discharge pressure and the position of the control valve. When the control valve is used in a propulsion drive system, it thereby becomes possible in a simple manner to avoid an increase in the speed of the vehicle when it is traveling downhill or in the event of a change in the load.

The differential pressure control valve is appropriately realized in the form of a slide control valve that throttles the flow in intermediate positions. The slide control valve has a first switched position in which the connection between the control pressure line and the control pressure chamber that acts toward the closed position of the throttle valve is blocked and the control pressure chamber of the throttle valve acting in the direction of the closed position is in fluid communication with a reservoir, and a second switched position in which the control pressure line is in communication with the control pressure chamber of the throttle valve that acts toward the closed position and the connection between the control pressure chamber that acts in the closed position and the reservoir can be closed, whereby the differential pressure control valve can be pressurized by the pressure upstream of the differential pressure control valve in the control pressure line toward the second switched position, and toward the first switched position by the pressure in the control line downstream of the differential pressure control valve and by a spring. With such a differential pressure control valve, the differential pressure and thus the pressure difference that actuates the throttle valve can be kept constant independently of the discharge pressure of the consumer and independently of the position of the actuator element of the control valve to the value set by the spring. It is thereby possible for the throttle valve to control with a high degree of precision the flow of hydraulic fluid flowing from the consumer to the reservoir, whereby the quantity of hydraulic fluid discharged is determined only by the aperture width of the control valve.

It is particularly advantageous if the consumer is realized in the form of a single-action hydraulic cylinder, in particular in the form of a lifting cylinder of a lifting frame of an industrial truck. The load on a lifting cylinder of an industrial truck is generally exerted in the form of a suspended load, i.e., a load that acts in the discharge direction. When the hydraulic cylinder is under a load, the control valve of the invention thereby provides an easy way to limit and to control the speed of descent independently of the load.

The consumer can also be realized in the form of a double-action hydraulic cylinder, in particular in the form of a boom cylinder or a cylinder on the mast of an excavator. With the control valve of the invention, it is also possible to easily achieve a control of the speed of descent that is independent of the load being exerted on the cylinder on double-action cylinders under load, for example, on the boom cylinder or the rod side of the mast cylinder of an excavator.

The consumer can also be realized in the form of a rotating consumer, in particular in the form of the propulsion motor of a hydrostatic propulsion system. As a result of the restriction of the discharge quantity, it is thereby possible, using the hydrostatic propulsion drive system, to control the speed of propulsion, for example, when a vehicle is traveling downhill, independently of the load.

In one preferred embodiment, in which the distributing slide valve is mounted so that it can move longitudinally in a housing boring, there is a first circular groove that is in communication with a pump, at least one second circular groove that can be placed in communication with a user connection, at least one third circular groove that can be connected to a reservoir and at least one fourth circular groove to measure the load pressure of the consumer in the housing boring. The distributing slide valve can be placed in communication with the circular grooves by means of radial penetrations, and the throttle valve is realized in the form of a control piston located in the distributing slide valve. At least one additional circular groove may be provided in the housing boring, which additional circular groove is effectively connected by means of a control pressure line with the consumer connection. The valve device is preferably located in the control pressure line and when the consumer connection is in communication with the reservoir, the circular groove can be placed in communication with the control pressure chamber acting in the closing direction of the throttle valve. The result is a particularly simple construction, because the restriction of the quantity of hydraulic fluid discharged at the control valve requires the provision of only one additional circular groove in the housing boring. The additional circular groove can be placed in communication with the corresponding control surface of the throttle valve, whereby the circular groove is in communication with the consumer connection by means of a control pressure line in which the valve device is located.

BRIEF DESCRIPTION OF THE DRAWINGS

Additional advantages and details of the invention are explained in greater detail below, with reference to the exemplary embodiments illustrated in the accompanying schematic drawing figures, in which like reference characters identify like parts throughout.

DESCRIPTION OF THE PREFERRED EMBODIMENTS

Figure 1:
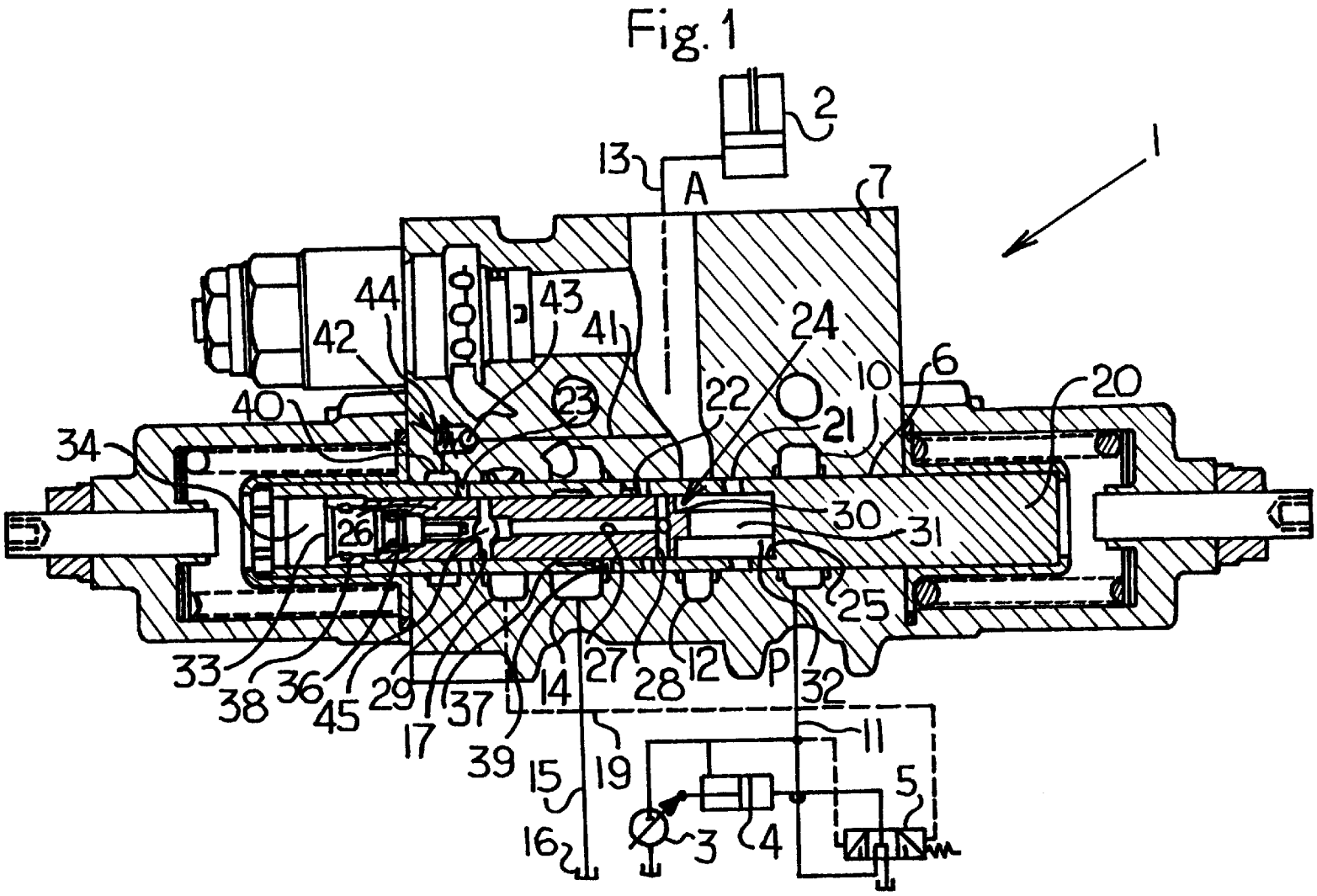
FIG. 1 is a sectional, partially schematic view of a control valve of the invention particularly suited for controlling a single-action consumer.

For purposes of the discussion hereinafter, the terms "left", "right" and similar spacial indicators relate to the invention as depicted in the drawings. However, it is to be understood that the invention may assume various alternative variations and orientations without departing from scope of the invention. It is also to be understood that the specific devices illustrated in the attached drawings and described in the following specification are simply exemplary embodiments of the invention and are not to be considered as limiting to the scope of the invention.

FIG. 1 shows a control valve 1 particularly well suited for the actuation of a single-action consumer 2, for example, of a hydraulic cylinder, in a load-sensing drive system. The system includes a pump 3 that has an adjustable delivery volume, the actuator device 4 of which can be pressurized by a demand flow controller 5.

The control valve 1 is realized in the form of a longitudinal slide valve and is mounted so that it can move longitudinally in a housing boring 6 of a valve housing 7. Molded into the housing boring 6 are a plurality of circular grooves that are at a spaced axial distance from one another. One circular groove 10 is in communication with a pump connection P of a delivery line 11 that is connected to the pump 3. Additional consumers can be connected to the delivery line 11, each of which can be actuated by means of a control valve. In this case, the pump 3 works in an open circuit. A circular groove 12 that is at an axial distance from the circular groove 10 is in communication by means of a channel with a consumer connection A, which is connected by means of a line 13 with the consumer 2. An additional circular groove 14 is connected to a tank connection T and is in communication via a discharge line 15 with a reservoir 16. To measure the load pressure of the consumer 2, there is a circular groove 17 which is connected by means of a load pressure signal line 19 to the demand flow controller 5.

The valve slide 20 of the control valve 1 has a plurality of radial penetrations 21, 22 and 23 which are axially spaced from one another, and which can be placed in fluid communication with the circular grooves 10, 12, 14 and 17 when there is a deflection of the valve slide 20.

In the valve slide 20 there is a longitudinal boring 25 in which a control piston 26 of a throttle valve 24 is mounted so that it can move longitudinally. In the control piston 26 there is a longitudinal boring 27 which can be connected by means of a transverse boring 28 to the radial penetration 22 of the valve slide 20. An additional transverse boring 29 that starts at the longitudinal boring 27 is in fluid communication with the radial penetration 23 located in the valve slide 20.

The control piston 26, on one end surface 30, has a journal 31, with which the control piston 26 forms an annulus 32 on the end of the boring 25. The other end surface 33 of the control piston 26 opposite the end surface 30 forms, in the boring 25, a control pressure chamber 34 that acts in the closing direction of the throttle valve 24 and in which there is a spring 38 and which is connected by means of a boring 36 to the longitudinal boring 27. Between the transverse borings 28 and 29, a check valve 45 is located in the longitudinal boring 27, so that the higher of the pressures in the transverse borings 28, 29 is available via the boring 36 in the control pressure chamber 34. On the outer periphery, the control piston 26 has a circular groove 37 which is in fluid communication with the transverse boring 29 and is connected to an inclined throttle boring 39 located in the valve slide 20.

When there is a deflection of the valve slide 20 to the right in FIG. 1 to lift a load on the consumer 2, the circular groove 10 is placed in fluid communication via the radial penetration 21 with the annulus 32. Hydraulic fluid thus flows from the pump 3 via the radial penetration 21 acting as a throttle point into the annulus 32. As a result of which, the control piston 26 of the throttle valve 24 is moved by the pressure on the end surface 30 downstream of the throttle point of the valve slide 20 to the left in FIG. 1, and the control piston 26 with the end surface 30 exposes a fluid communication between the annulus 32 and the radial penetration 22 and thus the consumer 2 via the circular groove 12 and the line 13. The pressure in the radial penetration 22 and thus the load pressure of the consumer 2 is reported via the transverse boring 28 and the longitudinal boring 27 via the open check valve 45 into the radial penetration 23, which is in fluid communication with the circular groove 17. The load pressure of the consumer is thereby available via the load pressure signal line 19 on the spring side of the demand flow controller 5. The load pressure of the consumer is also available via the boring 36 in the control pressure chamber 34 and pushes the control piston 26 together with the spring 38 toward the closed position. On a propulsion system with a plurality of consumers, the check valve 45 ensures that the highest load pressure of the actuated consumers is available at the demand flow controller 5 and the control pressure chambers 34 act in the closing direction of the throttle valve.

A specified flow of hydraulic fluid and thus a specified speed of movement of the consumer 2 are thereby specified at the radial penetration 21, whereby, by means of the demand flow controller 5, the actuator device 4 of the pump 3 is deflected to produce this flow of hydraulic fluid. The control piston 26 of the throttle valve 24 on the end surface 30, together with the radial penetration 22, forms a throttle point, whereby the speed of movement of the consumer is kept constant, independently of the load, at the speed of movement specified by the control valve 1.

Up to this point, the control valve 1 is similar to devices of the prior art. However, the invention teaches that an additional circular groove 40 is molded into the housing boring 6, and is in connected by means of a control pressure line 41 located in the valve housing 7 to the channel that is in fluid communication with the circular groove 12, and is thus in fluid communication with the consumer connection A. In the control pressure line 41, there is a valve device 42 that generates a differential pressure, for example, a biased valve realized in the form of a spring-loaded check valve 43 that opens toward the circular groove 40. The differential pressure that can be generated at the check valve 43 is thereby specified by the bias of the check valve 43. The bias is thereby determined by a spring 44, which can be either fixed or adjustable.

In the event of a deflection of the control valve 1 to the left in FIG. 1, to lower a load that is being supported by the consumer 2, the circular groove 12 that is in communication with the consumer connection A is connected via the radial penetration 21 to the annulus 32, whereby the radial penetration 21 forms an outlet-side throttle point, the aperture width of which specifies the speed of movement of the consumer 2. The radial penetration 22 is in communication with the circular groove 14 and thus with the tank connection T.

By means of the control pressure line 41, the pressure upstream of the outlet-side throttle point formed by the radial penetration 21 is available at the valve device 42 that is realized in the form of the spring-loaded check valve 43. The pressure in the circular groove 40 is reduced by a corresponding value set on the spring 44 of the valve device 42, whereby a differential pressure that corresponds to the spring bias is produced at the valve device 42. The circular groove 40 is thereby in fluid communication with the control pressure chamber 34 that acts in the closing direction of the throttle valve 24 via the radial penetration 23, the transverse boring 29, the longitudinal boring 27 and the boring 36. At the control piston 26, in the opening direction, therefore, the pressure available is the pressure in the annulus 32, and in the closing direction, the pressure available is the pressure corresponding to the consumer pressure minus the differential pressure generated at the valve device 42, as well as the force of the spring 44, whereby the throttle valve 24 is pressurized by a corresponding pressure difference on the end surfaces 33 and 30 toward the open position and exposes a specified opening cross section of the annulus 32 to the radial penetration 22 via the end surface 30. The speed of descent of the consumer 2 can thereby be kept constant and thus restricted independently of the load that is being supported by the consumer 2 at the speed value specified by the aperture width of the radial penetration 21. A connection between the control pressure chamber 34 and the reservoir 16 is created by the throttle boring 39 that is in fluid communication in the descent position of the control valve 1 with the circular groove 14, whereby the pressure in the annulus 32 and thus in the control pressure chamber 34 can be adapted to changing consumer pressures.

The quantity of hydraulic fluid discharged from the consumer 2 can be increased by increasing the pressure difference available on the end surfaces 30 and 33 on the throttle valve 24, e.g. by increasing the differential pressure of the valve device 42 and thus the bias of the spring 44. Correspondingly, by decreasing the differential pressure of the valve device 42 and thus the spring bias, the pressure differential at the throttle valve 24 can be reduced, whereby the quantity of hydraulic fluid discharged from the consumer 2 is reduced. By changing the pressure difference generated at the valve device 42, it thereby becomes possible in a simple manner to adjust the volume flow on the discharge side of the consumer 2 to the volume flow on the admission side.

Figure 2:
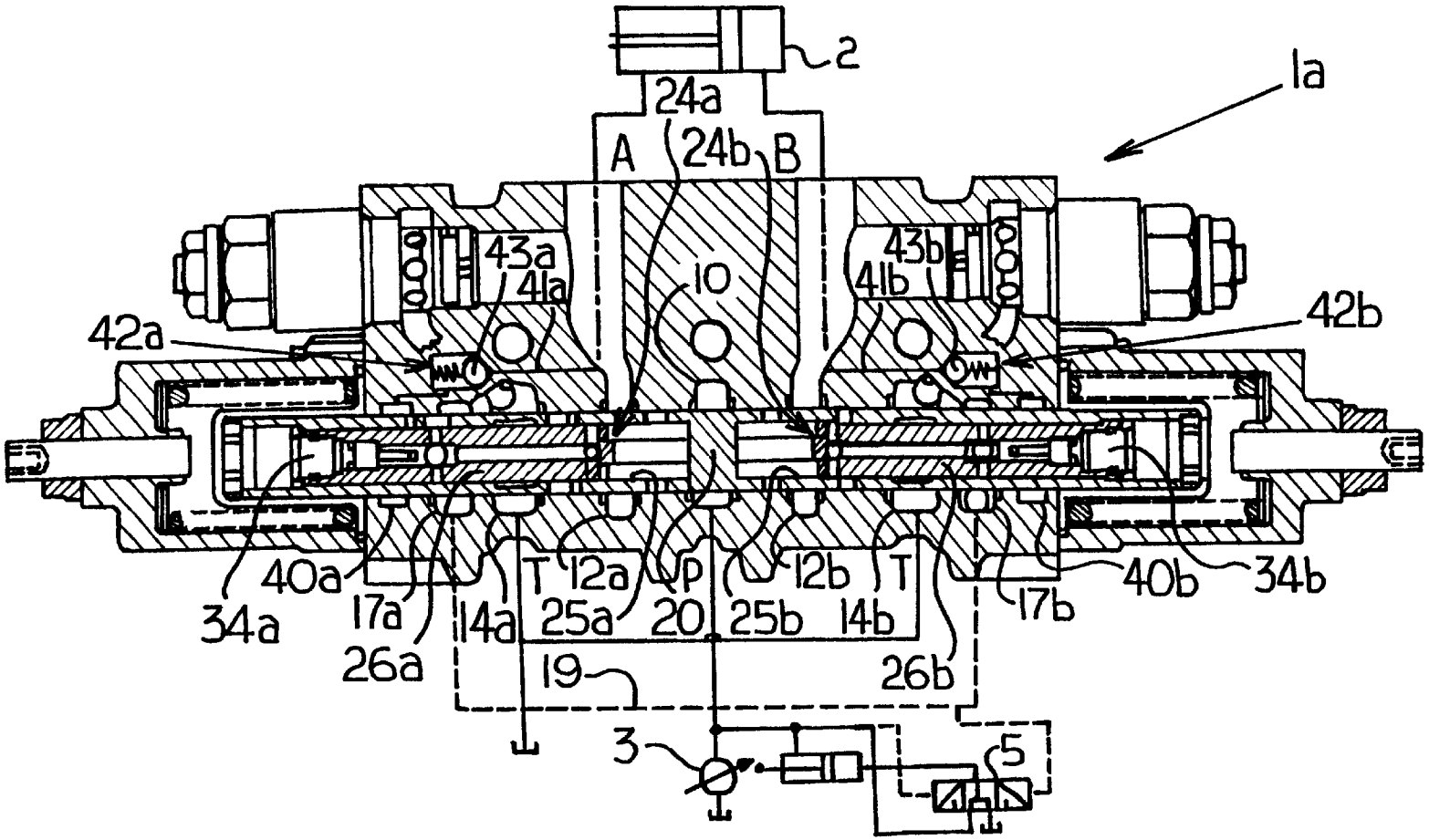
FIG. 2 is a sectional, partially schematic view of a control valve of the invention particularly suited for controlling a double-action consumer.

FIG. 2 shows one arrangement of a control valve 1A of the invention for the actuation of a double-action consumer 2, for example, of a hydraulic cylinder. In this case, the control valve 1A is similar to the control valve 1 in FIG. 1, with a configuration that is substantially symmetrical with respect to the circular groove 10. Similar components are identified by similar reference numbers in both figures.

In the central portion of the valve housing 7, in the housing boring 6, there is a circular groove 10 that is in communication with the pump connection P. From the center to the outside there are circular grooves 12*a*, 12*b*. The circular groove 12*a* is in communication with the consumer connection A, for example, with the rod side of the hydraulic cylinder. The circular groove 12*b* is in communication with the consumer connection B, for example, the piston side of the hydraulic cylinder. Additional circular grooves 14*a*, 14*b* are in communication with tank connections T, respectively. Circular grooves 17*a* and 17*b* are connected to a load pressure signal line 19 which runs to the spring side of the demand flow controller 5 of the pump 3.

In the central portion of the valve slide 20 there is a separation web, whereby housing borings 25*a*, 25*b* extend from the separation web toward the outer ends of the valve slide 20. A control piston 26*a*, 26*b* of a throttle valve 24*a*, 24*b* is located in each housing boring 25*a* and 25*b*, respectively.

When the distributing valve slide 20 is deflected to the right in FIG. 2, the consumer connection A represents the admission-side consumer connection and the consumer connection B represents the discharge-side consumer connection. Accordingly, when there is a deflection to the left in FIG. 2, the consumer connection B forms the admission-side consumer connection and the consumer connection A forms the discharge-side consumer connection.

To restrict the quantity of hydraulic fluid discharged in both directions of movement of the consumer 2, the control pressure chambers 34*a* and 34*b* of the control pistons 26*a* and 26*b* can be pressurized toward the closed position by respective valve devices 42*a* and 42*b*. For this purpose there are two control pressure lines 41*a*, 41*b* in the valve housing 7 and two circular grooves 40*a*, 40*b* in the housing boring 6. The valve devices 42*a*, 42*b* are thereby realized in the form of biased valves, for example, in the form of spring-loaded check valves 43*a*, 43*b*.

Figure 3:
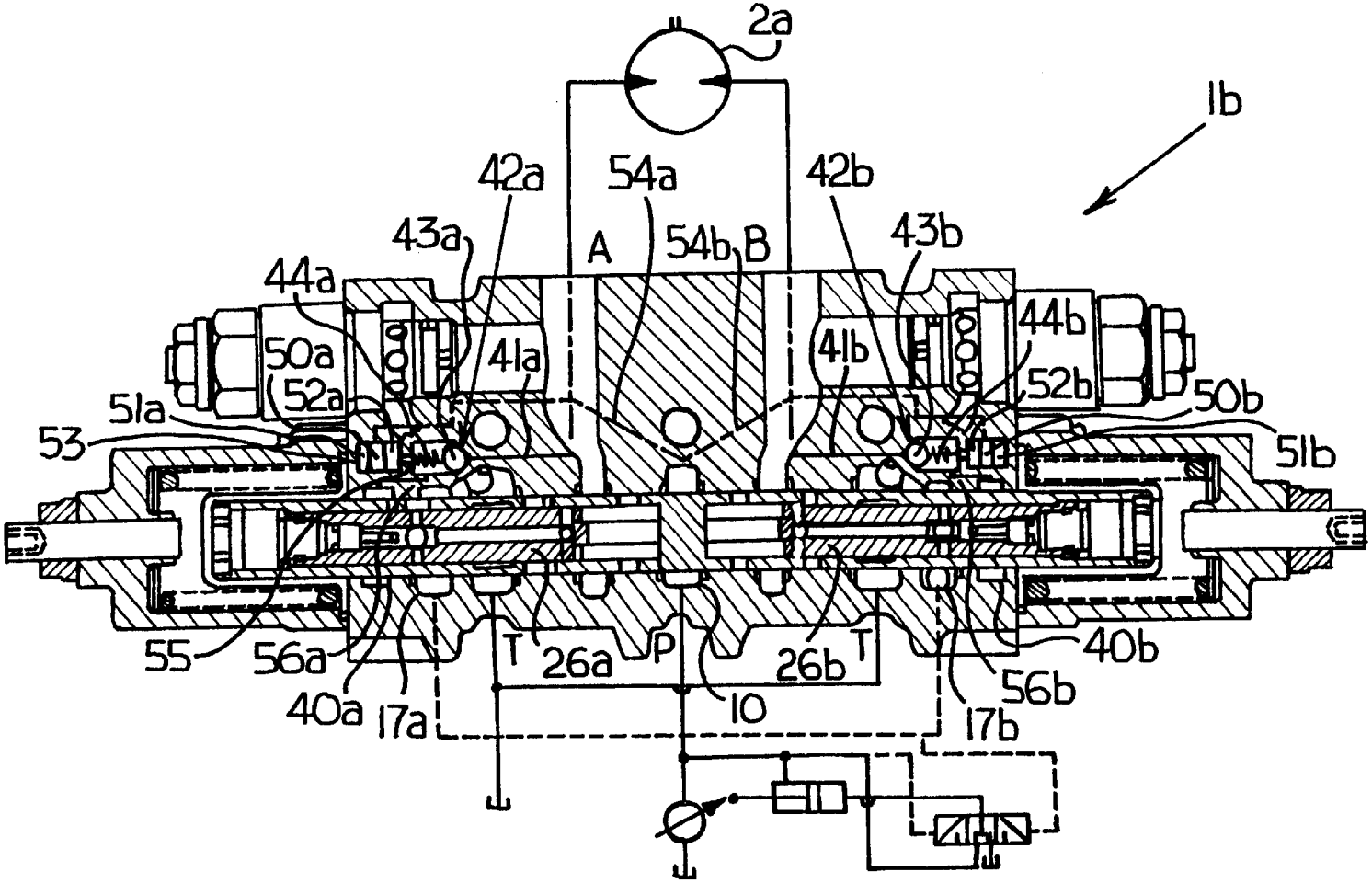
FIG. 3 is a sectional, partially schematic view of a refinement of the control valve of the invention illustrated in FIG. 2.

FIG. 3 shows a refinement of the control valve 1A illustrated in FIG. 2. In this case, the control valve 1B is provided to pressurize a rotary consumer 2*a* that can be operated in both directions of rotation, for example, a propulsion motor of a hydrostatic propulsion system.

The differential pressure that can be produced at the valve devices 42*a*, 42*b* respectively, and thus the bias of the valve devices 42*a*, 42*b* that can be realized in the form of spring-loaded check valves 43*a*, 43*b*, for example, can thereby be varied hydraulically. For this purpose, the valve devices 42*a*, 42*b* are effectively connected with respective auxiliary pistons 50*a*, 50*b*. The auxiliary pistons 50*a*, 50*b* are located in respective borings 51*a*, 51*b* of the housing boring 6 so that they can move longitudinally, and have respective journals 52*a*, 52*b* which are connected with the springs 44*a*, 44*b* of the respective check valves 43*a*, 43*b*. One end surface 53 of each auxiliary piston 50*a*, 50*b* that acts in the direction of increasing the bias of the springs 44*a*, 44*b* can thereby be pressurized by the delivery pressure of the pump 3. For this purpose, the borings 51*a*, 51*b* are connected to the circular groove 10 by means of respective control pressure lines 54*a*, 54*b*. An end surface 55 that acts in the direction of a decrease in the spring bias can be pressurized by the load pressure of the consumer 2*a*. For this purpose, the boring 51*a* is placed in communication by means of a control pressure line 56*a* to the circular groove 17*a* and the boring 51*b* by means of a control pressure line 56*b* to the circular groove 17*b*. The bias of the springs 44*a*, 44*b* of the respective valve devices 42*a*, 42*b* and thus the pressure difference that can be produced at the valve devices 42*a*, 42*b* can thereby be varied as a function of the pressure difference formed from the pump pressure and the load pressure. The limit quantity of the pump 3 and of fluctuations in the speed of the pump 3 can thereby be taken into consideration.

Figure 4:
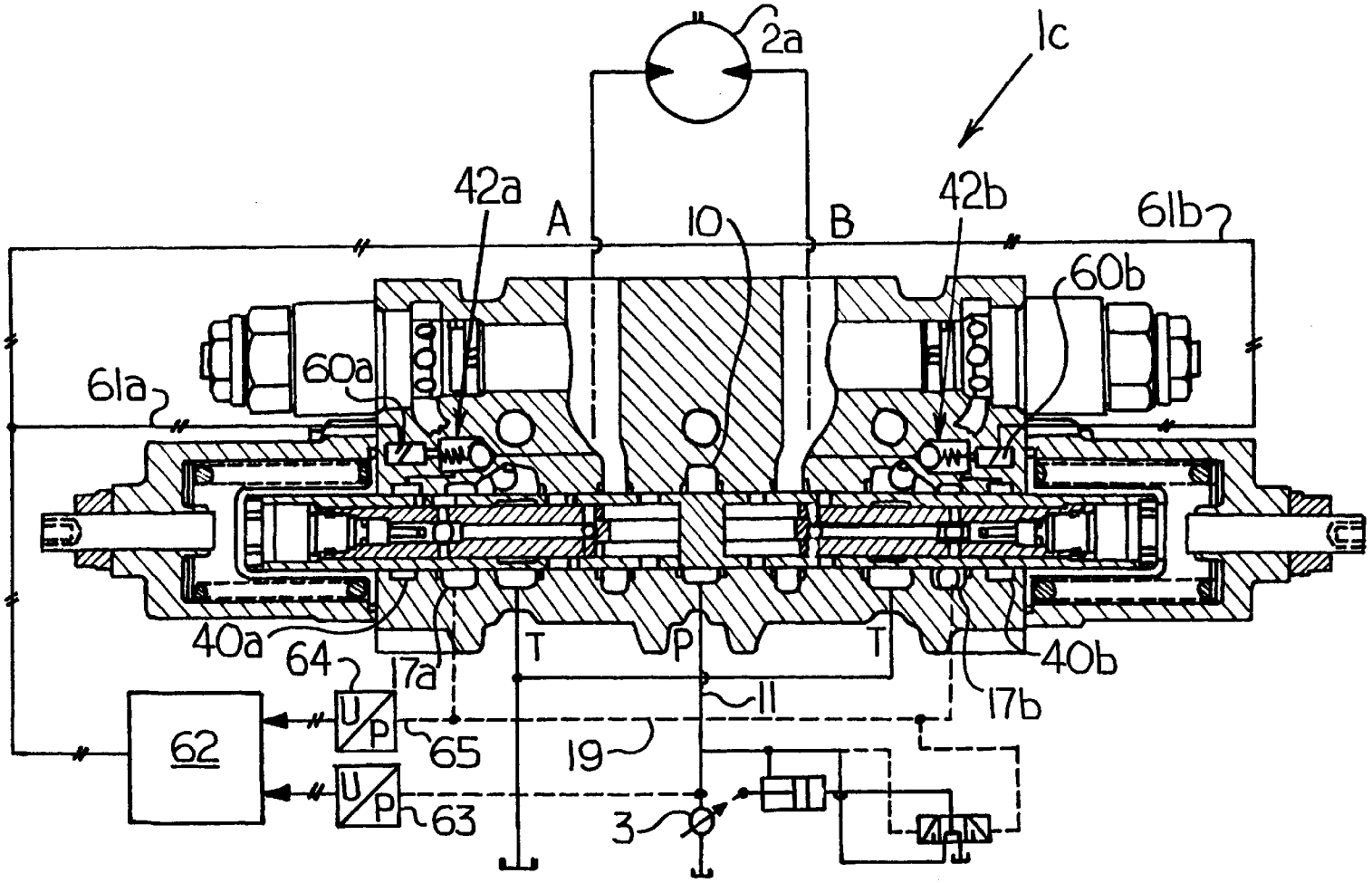
FIG. 4 is a sectional, partially schematic view of a further refinement of the control valve of the invention illustrated in FIG. 2.

FIG. 4 shows a control valve 1C, which is a refinement of the control valve 1A illustrated in FIG. 2 in which a change in the pressure difference can be generated at the valve device 42*a*, 42*b* electrically.

In this case, the valve devices 42*a*, 42*b* realized in the form of check valves 43*a*, 43*b* to increase the spring bias, are each connected with respective magnet systems 60*a*, 60*b*, for example, proportional magnets, which are connected by means of control lines 61*a*, 61*b* to the output of an electronic regulator device 62. The electronic regulator device 62 is connected on the input side with a pressure sensor 63 that measures the delivery pressure of the pump 3. For this purpose, the pressure sensor 63 can be connected, for example, to the delivery line 11 of the pump 3. There is also a pressure sensor 64 to measure the load pressure of the consumer 2*a*, which is connected to the load pressure signal line 19, for example, by means of a control pressure line 65. The pressure difference formed from the pump pressure and the load pressure can thereby be easily used as part of an electrical method to vary the bias of the check valve and thus to change the differential pressure of the valve device 42*a*, 42*b*.

Figure 5:
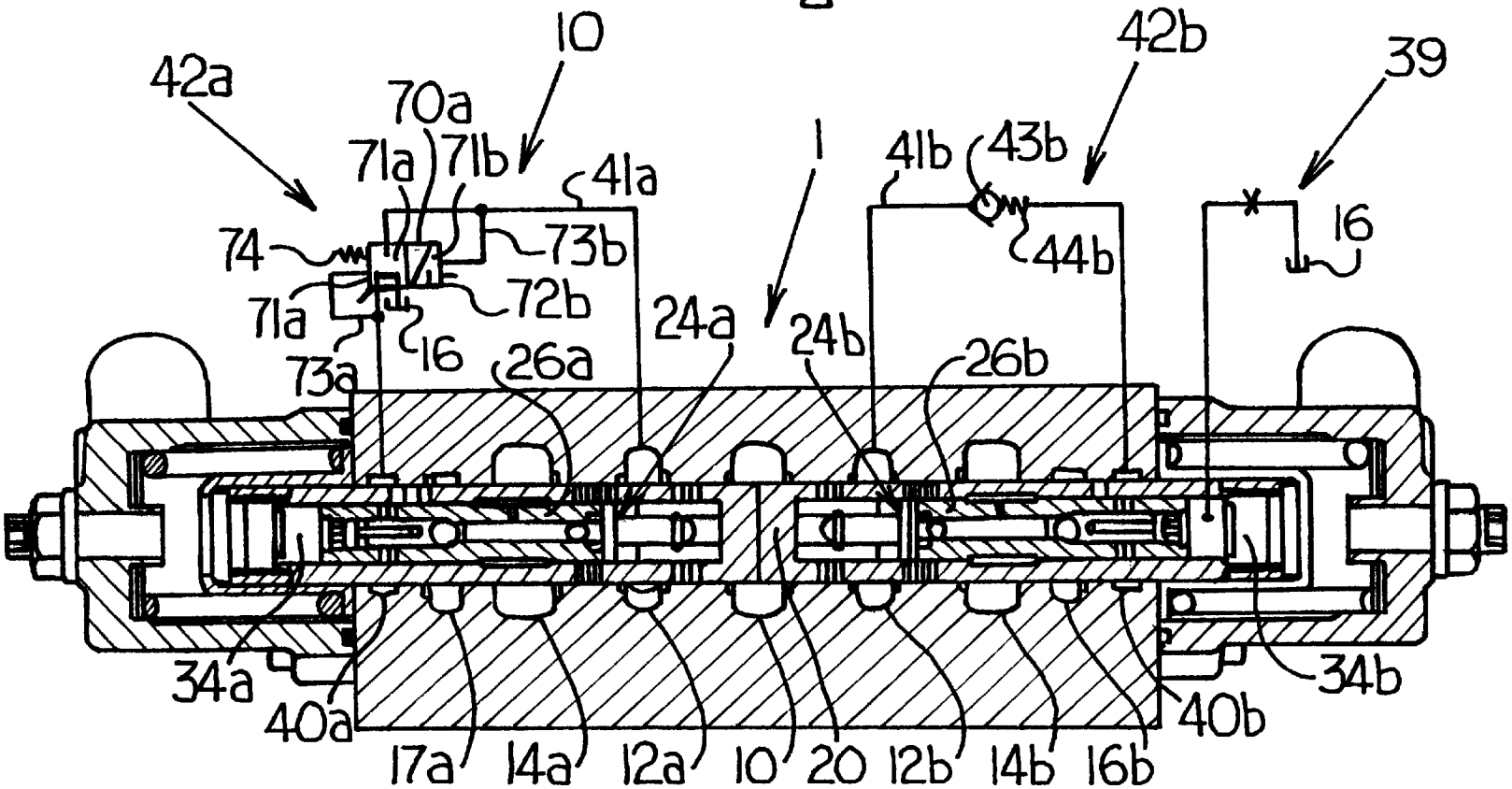
FIG. 5 is a sectional, partially schematic view of an additional embodiment of a control valve of the invention.

On the control valve illustrated in FIG. 5, the right side with respect to the circular groove 10 corresponds to a control valve as illustrated in FIGS. 1 to 4. A valve device 42*b* realized in the form of a check valve 43*b* is located in a control pressure line 41*b*. The control pressure chamber 34*b* of the throttle valve 24*b* that acts in the closing direction is thereby relieved by means of a throttle to the reservoir, which can be formed, for example, as illustrated in FIG. 1, by an inclined throttle boring 39 in the valve slide 20.

The left side in FIG. 5 illustrates an additional embodiment of a control valve 1D as claimed by the invention, in which the valve device 42*a* located in the control pressure line 41*a* is realized in the form of a differential pressure control valve 70*a*.

In place of the illustrated arrangement of the differential pressure control valve 70*a*, it is also possible to have an arrangement in which, when there is a control valve to actuate a double-action consumer, there are individual differential pressure control valves 70*a*, 70*b* in the respective control pressure lines 41*a*, 41*b*. With a control valve to actuate a single-action consumer as illustrated in FIG. 1, it is also possible to locate a differential pressure control valve 70 in the control pressure line 41.

The differential pressure control valve 70*a* is realized in the form of a distributing slide valve that exerts a throttling action in intermediate positions, with a first switched position 71*a* and a second switched position 71*b*. In the first switched position 71*a*, the connection between the control pressure line 41*a* with the circular groove 40*a* is blocked. In this switched position 71*a*, the segment of the control pressure line 41*a* that is in communication with the circular groove 40*a* is also connected via the differential pressure control valve 70 to the reservoir 16. In the second switched position 71*b*, the control pressure line 41*a* is in communication with the circular groove 40*a*. In this switched position 71*b*, the connection of the control pressure chamber 34 to the reservoir 16 is blocked. The differential pressure control valve 70 has a control pressure surface 72*b* that acts toward the second switched position 71*b*, which control pressure surface 72*b* can be pressurized by the pressure upstream of the differential pressure control valve 70 in the control pressure line 41*a* and thus at the discharge pressure of the consumer in the circular groove 12*a*. For this purpose a control pressure branch line 73*b* runs from the segment of the control pressure line 41*a* that is in communication with the circular groove 12*a* to the control pressure surface 72*b*. A control pressure surface 72*a* that acts in the direction of the first switched position 71*a* can be pressurized by the pressure downstream of the differential pressure control valve 70*a* in the control pressure line 41*a* and by a spring 74. For this purpose, a control pressure branch line 73*a* is connected to the segment of the control pressure line 41*a* that is in communication with the circular groove 40*a*, which control pressure branch line 73*a* runs to the control pressure surface 72*a*.

When the valve slide 20 is deflected to the left in FIG. 5 by means of the control pressure line 41*a*, a connection is created between the circular groove 12*a* that is in fluid communication with the discharge side of the consumer and the control pressure chamber 34*a* of the throttle valve 24*a*. The differential pressure control valve 70*a* is thereby deflected toward the switched position 71*b* and generates a differential pressure that equals the bias of the spring 74. As a result of the presence of the separate tank relief line of the differential pressure control valve 70*a* to the reservoir 16, it becomes possible, when the differential pressure control valve 70*a* is deflected toward the switched position 71*b*, for a reduced volume of hydraulic fluid to flow via the differential pressure control valve 70*a*. It thereby becomes possible for the differential pressure at the differential pressure control valve 70*a* determined by the setting of the spring 74 to be independent of the discharge pressure of the consumer and the deflection of the slide of the control valve 1D. When the control valve 1D is used in a propulsion drive system, the throttle valve 24*a* can thereby be pressurized independently of the discharge pressure of the propulsion motor and of the deflection of the slide of the throttle valve 24*a* to maintain a constant pressure difference toward an open position, whereby when there is a change in load or when the truck is traveling downhill, the propulsion drive system is operated at the speed of movement set at the control valve 1D. The spring can thereby either be fixed or continuously variable. The setting of the spring 74 can also be variable, as illustrated in FIGS. 3 and 4.

While the invention is described in detail herein, it will be appreciated by those skilled in the art that various modifications and alternatives to the arrangement can be developed in light of the overall teachings of the disclosure. Accordingly, the particular arrangements are illustrative only and are not limiting as to the scope of the invention which is to be given the full breadth of the appended claims and any and all equivalents thereof.

What is claimed is:

1. A control valve for the control of a hydraulic consumer substantially independent of a load being exerted, the control valve comprising:

a housing having a housing boring, a first groove in fluid communication with a channel, a second groove in fluid communication with a reservoir, and a third groove;

a distributing slide valve slideably mounted in the housing boring to control a direction of movement and a speed of movement of the consumer, the slide valve having a plurality of radial penetrations and a longitudinal boring;

a throttle valve control piston slideably mounted in the slide valve longitudinal boring and having a plurality of transverse borings, a first end and a second end;

an annulus formed at the first end of the control piston; and a control pressure chamber located adjacent the second end of the control piston, wherein the third groove is connected to the channel of the first groove by a control pressure line having a valve device, and wherein when the consumer is connected to the reservoir through the control valve, the first groove is in fluid communication with the annulus via a first radial penetration forming a throttle point and the second groove is in fluid communication with the reservoir via a second radial penetration such that a quantity of hydraulic fluid flowing out of the consumer is restricted by the throttle valve.

2. The control valve as claimed in claim 1, wherein when the consumer is connected with the reservoir, the throttle valve is pressurized toward a closed position by pressure upstream of the throttle point of the distributing slide valve transmitted through the control pressure line to the control pressure chamber.

3. The control valve as claimed in claim 2, wherein when the consumer is connected with the reservoir, the pressure acting in a direction of a closed position of the throttle valve is set by the valve device configured to generate a differential pressure.

4. The control valve as claimed in claim 3, wherein the valve device is configured such that the differential pressure is variable.

5. The control valve as claimed in claim 4, wherein the valve device includes a spring.

6. The control valve as claimed in claim 5, wherein the spring is an adjustable spring.

7. The control valve as claimed in claim 4, wherein the valve device is configured such that a differential pressure generated at the valve device is varied as a function of a pressure difference of a pump pressure and a load pressure of the consumer.

8. The control valve as claimed in claim 7, including an auxiliary piston connected to the valve device, which auxiliary piston is configured such that the auxiliary piston is pressurized in the direction of an increase in the differential pressure of the valve device by the pump pressure, and is pressurized in the direction of a reduction of the differential pressure of the valve device by the load pressure of the consumer.

9. The control valve as claimed in claim 4, wherein the differential pressure of the valve device is electrically variable.

10. The control valve as claimed in claim 9, including a proportional magnet connected to the valve device and connected on an output side with an electronic control device which is connected on an input side with pressure sensors to measure the pump pressure and the load pressure of the consumer.

11. The control valve as claimed in claim 3, wherein the valve device is located in a control pressure line in fluid communication with the consumer and a control pressure chamber that acts in the direction of the closed position of the throttle valve and wherein the valve device is a biased valve that opens in the direction of the control pressure chamber.

12. The control valve as claimed in claim 11, wherein the valve device is a spring loaded check valve.

13. The control valve as claimed in claim 1, wherein the consumer is a single-action hydraulic cylinder.

14. The control valve as claimed in claim 1, wherein the consumer is a double-action hydraulic cylinder.

15. A control valve for the control of a hydraulic consumer substantially independent of a load being exerted, the control valve comprising:

a distributing slide valve mounted for longitudinal movement in a housing boring;

a throttle valve configured as a control piston and located in the distributing slide valve;

a first circular groove in fluid communication with a pump;

at least one second circular groove configured to be placed in fluid communication with a user connection;

at least one third circular groove configured to be connected to a reservoir; and at least one fourth circular groove provided to measure the load pressure of the consumer in the housing boring, wherein the distributing slide valve can be placed in communication with the circular grooves by radial penetrations, wherein at least one additional circular groove is provided in the housing boring and is configured to be connected by a control pressure line with a consumer connection; and wherein a valve device is located in the control pressure line, such that when the consumer connection is in communication with the reservoir, the additional circular groove can be placed in communication with control pressure chamber acting in the closing direction of the throttle valve.

* * * * *